US005553708A

United States Patent [19]

Lawrence et al.

[11] Patent Number: 5,553,708

[45] Date of Patent: Sep. 10, 1996

[54] PACKAGING FOR SHIPPING SPENT FLUORESCENT LAMPS

[75] Inventors: Bruce J. Lawrence, Coopersburg; John M. Boyle, Slatedale; Scott A. Schreffler, Bethlehem, all of Pa.

[73] Assignee: Bethlehem Apparatus Co., Inc., Hellerton, Pa.

[21] Appl. No.: 461,201

[22] Filed: Jun. 5, 1995

[51] Int. Cl.[6] ..... B65D 85/42; B65D 85/20

[52] U.S. Cl. ..... 206/419; 206/443; 206/594; 206/523; 220/403

[58] Field of Search ..... 206/418, 419, 206/420, 443, 523, 591, 594; 220/403

[56] References Cited

U.S. PATENT DOCUMENTS

| | | | |
|---|---|---|---|
| 2,564,729 | 8/1951 | Shepard | 206/419 |
| 2,979,246 | 5/1956 | Liebeskind | 206/591 |
| 3,143,274 | 8/1964 | Maize | 206/419 |
| 3,973,675 | 8/1976 | Brand et al. | 206/418 |
| 4,681,225 | 7/1987 | Schuster | 206/591 |
| 4,905,898 | 3/1990 | Wade | 220/403 |
| 4,953,701 | 9/1990 | Maddock | 206/419 |
| 5,040,678 | 8/1991 | Lenmark, Sr. et al. | 206/523 |
| 5,249,685 | 10/1993 | Stephens | 206/523 |
| 5,441,170 | 8/1995 | Bane, III | 206/523 |

*Primary Examiner*—Paul T. Sewell
*Assistant Examiner*—N. Shian Lam
*Attorney, Agent, or Firm*—Eckert Seamans Cherin & Mellott

[57] ABSTRACT

Packaging for shipping spent fluorescent tubes includes an external paperboard box lined with a plastic bag that encloses a pair of end pads positioned on opposite ends of an array of sleeves. The sleeves form discrete cells in which a spent fluorescent tube can be inserted for shipping. The end pads include foam that is pressed into the ends of the sleeves when the box is shut and confine the tubes to the sleeves in the event of breakage. The foam protects the plastic bag liner by accommodating electrical pins of the lamps and also clamps the lamps in relatively fixed positions while functioning as a shock absorber. The plastic bag is tied closed for shipping so that any mercury which issues from a broken lamp is largely confined to the bag. The packaging better retains mercury for disposition by a recycler, as opposed to release into the environment, and is arranged to serve the convenience of the user for encouraging recycling of fluorescent tubes.

15 Claims, 3 Drawing Sheets

PACKAGING FOR SHIPPING SPENT FLUORESCENT LAMPS

BACKGROUND OF THE INVENTION

1. Field of the Invention

The invention relates to a shipping arrangement especially for spent fluorescent lamps, and in particular concerns packaging comprising a container having a plurality of internal cells defined by tubes disposed in a polymer bag, the cells separately carrying individual fluorescent lamps, the container having end pads within the bag for cushioning the ends of the lamps and retaining end pins of the lamps while protecting the bag.

2. Prior Art

Used fluorescent lamps are a potential waste problem in the municipal waste stream because they contain mercury. The mercury content of a standard four-foot (1.22 m), 1.5 inch-diameter (3.8 cm) cool white fluorescent lamp ranges from 27 to 54 mg per lamp. It is possible to specially make lamps of this size with as little as 10 mg of mercury, but mercury is needed to provide the ions that cause the tube to emit light in use. Given the large number of lamps in use, a substantial quantity of mercury is involved. When a fluorescent lamp is broken, 5–10% of its mercury immediately escapes as vapor. The remaining mercury will evaporate and enter the environment if the lamp is disposed in a municipal waste incinerator or can leach out if the lamp is disposed in a landfill, leading to potential pollution of the groundwater.

Mercury can build up in tissues over time and is harmful to the health of humans and wildlife. The Environmental Protection Agency (EPA) is considering whether to regulate the disposal of spent fluorescent lamps. See, 59 Fed. Reg. 38288 (No. 143 Jul. 27, 1994). The problem is difficult because spent fluorescent lamps are generated in a wide variety of settings, by a large number of individuals, families, businesses and the like, of a diffuse and diverse population, who collectively dispose of significant numbers of fluorescent lamps in the municipal waste stream, where they are easily broken and release their contents. The EPA is presently collecting data to quantify what risks are posed by the mercury in spent lamps, and what actions, if any, are reasonable to protect the environment and the health of the population.

Despite the fact that they are discarded as waste, spent fluorescent lamps are not valueless. They contain valuable recyclable materials. The mercury is one example of material in a spent fluorescent lamp that can be recovered on a profitable basis. Fluorescent lamps also have aluminum end-caps and phosphor coatings on the inside of the glass, both of which can be recycled profitably. In fact, there is an emerging market for spent fluorescent lamps and the component materials thereof.

Apart from loss of mercury in the form of vapor, unbroken lamps are substantially more valuable to the recycler than broken ones, for example because they are easier and safer to process. However, conventional methods of collecting and transporting spent fluorescent lamps are not sufficiently protective of the lamps to minimize or eliminate breakage.

The most common recycling method is to reuse the paperboard box in which the manufacturer originally packed and shipped the fluorescent lamps when new. New lamps are packaged in bulk, for example thirty to a box, separated from each other by supportive packaging material inserted between the lamps to prevent breakage in shipment. The interstitial packaging material functions the same way that an egg carton keeps eggs from touching each other, namely providing shapes complementary to the lamps to cushion and hold the lamps in place. For the most part, the packaging material is disposed between adjacent rows or columns of lamp tubes, but end elements can engage around the ends of the tubes as well, reserving space for the electrical pins that extend from the ends. About twelve separate pieces of this interstitial material are used to pack a box of thirty lamps in a five-by-six array. Each separate piece is about the size of a half dozen egg carton. The tubes are held in position by the interstitial pieces, and vice-versa.

As the new tubes are removed from the box and used, some of the interstitial packaging pieces are often lost, such as the end pieces that engage over the ends of the tubes, which must be removed to withdraw a tube. Insofar as interstitial pieces are provided along the length of the tubes, the arrangement of these pieces is lost when the adjacent tubes are removed. In any event, when it comes time to load the box with spent lamps, the interstitial packaging material may be missing, or at least is no longer arranged to provide an array of parallel tube positions. The user cannot readily regain the arrangement because it depends on the cooperative support of both the tubes and the interstitial packaging.

As a result, the manufacturer's box typically is repacked with spent tubes without the interstitial packaging material. The boxes are usually packed with more or less tubes than originally so that the tubes are either tight and resting laterally against one another or are loose and rattling against one another. The resilience of the box bears inwardly on the lamps in the overpacked boxes so that even when the box is at rest the lamps are under strain. Any shocks to these boxes are applied directly to the lamps. Partially filled boxes allow lamps to crash into one another and the boxes collapse easily when additional boxes are stacked on top. Moreover, the person repacking the box may have little incentive to handle the lamps with care because as far as that person is concerned the lamps are waste. For all these reasons, breakage in packing, handling and shipping is not uncommon.

What is needed is packaging which will overcome the shortcomings of the present methods of collecting and shipping spent lamps.

SUMMARY OF THE INVENTION

It is an object of the invention to provide improved packaging for shipping spent fluorescent lamps.

It is another object to provide a form of packaging that can protect the lamps as they are collected and shipped to a recycler, and is sufficiently convenient and foolproof as to function effectively as a collection and shipping apparatus without substantial attention or care by the user to safeguard the lamps.

It is also an object to facilitate and encourage collection and recycling of fluorescent tubes for better protection of the environment and of human health.

It is a further object that packaging as described is reusable over a number of cycles as well as be economical in other ways such as being inexpensive to make and ship.

These and other aspects and objects are provided according to the invention in packaging for shipping spent fluorescent tubes and other elongated glass lamps and the like. The packaging comprises a main container, a substantially fluid tight liner, a plurality of cushioning sleeves within the liner that maintain a relative array of spaces for lamps, and two opposite lamp-end shock absorbers, also within the liner, arranged to engage the electrical pins of the tubes.

The container has a bottom wall and side walls attached together to define a receptacle. The side walls extend from the bottom wall to upper edges that define a mouth for the receptacle. Foldably attached to the upper edges are flaps which can be open and shut to load and unload the container.

The liner is open at an upper end and closed at the bottom, providing a bag lining the bottom and side walls, which bag can be closed off with a tie to seal the container contents. The open end of the bag is coextensive with the mouth of the container. The lower one of the two pads is inserted into the bag and disposed at the bottom of the container, where the lower pad wedges against the four side walls to retain the bottom of the liner in the bottom of the container.

The container is sufficiently long to accommodate fluorescent tubes and the end pads. The supportive sleeves are elongated and extend along at least part of the length of the tubes. The sleeves can extend the full length of the tubes between the end pads, and preferably extend a substantial distance so as to keep the tubes spaced laterally adjacent one another along their lengths. The sleeves are arranged in an array in the liner and bear laterally against one another so as to maintain an array of tube positions in the container with or without the tubes inserted therein.

Preferably, one end of the sleeves is arranged to rest against the end pad at the bottom of the container and the other end rests against the end pad at the top of the container when closed. In this manner, the sleeves and end pads define a complete supportive and protective array. The end pad shock absorbers are made and dimensioned to establish insulation from shock and to protect the liner from being pierced by the prong shaped electrical terminals on the ends of the lamps. When the container is closed over the top end pad, the end pads receive the prong terminals and clamp the lamps endwise up to their end caps. The sleeves engage around the lamps to protect them from one another. The bag closes the package.

By providing sleeves extending the full length of the tubes, the shock absorbers abut against the ends of the sleeves to effectively enclose the tubes. This is helpful to seal in material in the event that a lamp is broken, including shards of glass and phosphor dust. The shards of glass otherwise would tend to damage the plastic liner if not properly contained.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
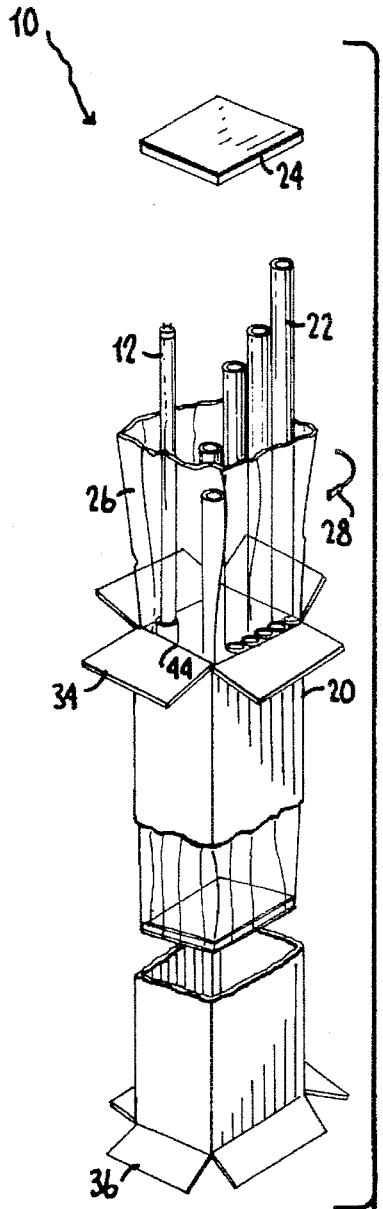
FIG. 1 is an exploded perspective view of packaging for shipping spent fluorescent lamps in accordance with the invention, with portions broken away.

In FIG. 1, a packaging system 10 in accordance with the invention for shipping spent fluorescent lamps 12 comprises a container 20, a plurality of sleeves 22, and opposite shock-absorbing pads 24. The sleeves 22 and end pads 24 can be sealed up in a plastic bag 26 that lines the container 20, which is tied off by a cable strap 28 or the like.

Figure 2:
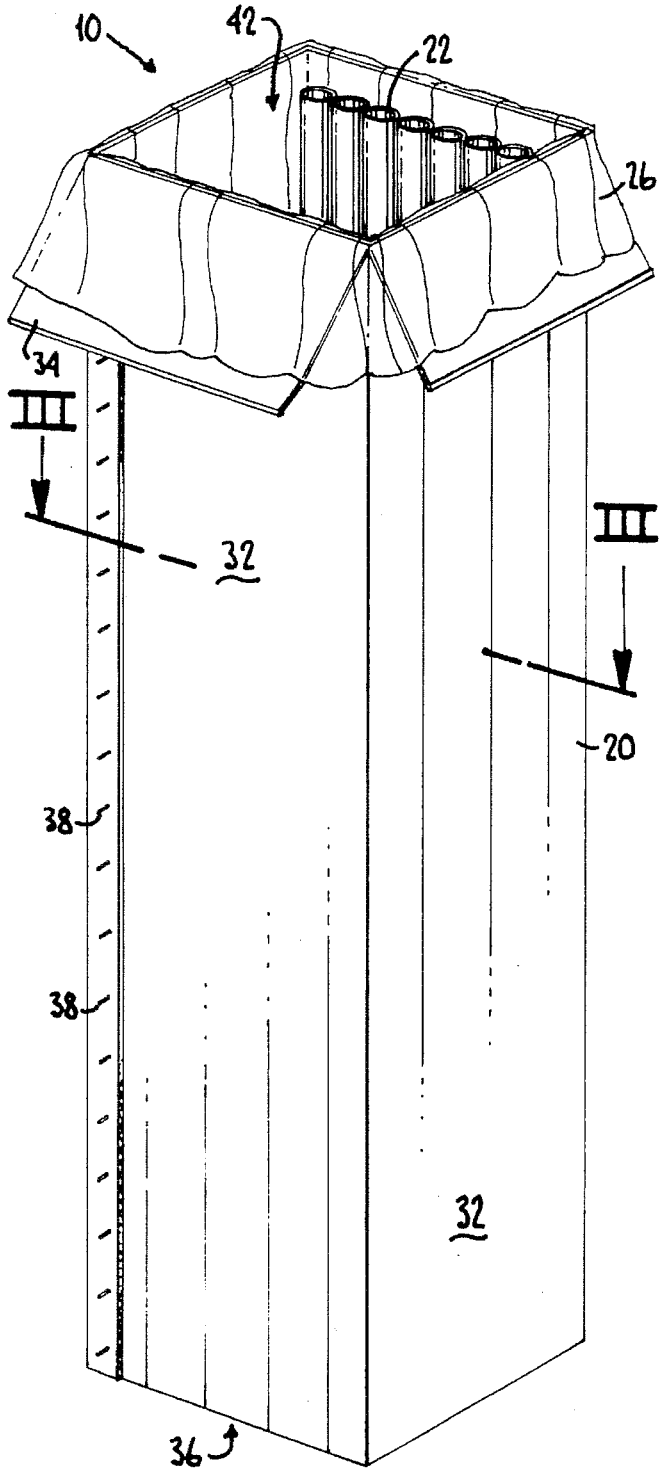
FIG. 2 is an enlarged perspective view of the container thereof.

The container 20 is constructed of paperboard such as corrugated craft, folded up from a flat rectangular blank. The container is preferably a durable grade of material as suitable for reuse, and preferably is folded from the blank by creasing and without cutting along fold lines, and slotted to separate adjacent flaps for closing the top and bottom. The container 20 has a rectangular box shape, with four side walls 32 and upper and lower sets flaps 34 and 36. FIG. 2 shows that opposite edges of the original blank can be overlapped and affixed to one another via metal-staple stitching 38 and preferably also a waterproof adhesive.

The lower sets of flaps 36 are preferably permanently attached to one another to close the bottom, via metal staples, waterproof adhesive, and/or tape with waterproof adhesive. As shown in FIG. 2, the container 20 is oriented upright with the lower set of flaps 36 closed to define a bottom wall of the container 20. However, the container can be oriented otherwise (e.g., elongated horizontally) and accordingly, terms like "bottom", "upper", "lower" and "side" are relative terms used merely for convenience in this description and not to limit the invention to any particular orientation.

The four side walls 32 and the bottom wall 36 define a receptacle 42 for which the fold lines 44 of the upper set of flaps 34 define a mouth. The upper set of flaps 34 have a shut position (not shown) and various open positions (e.g., FIG. 2), and can be releasably secured shut via metal staples and/or tape and the like.

The flexible bag 26 is preferably durable and fluid-tight. A 4-mil (0.10 mm) thick polyethylene bag can be used, although any suitable material, either polymeric or non-polymeric, of appropriate impermeability and durability will suffice. The bag 26 is inserted in the mouth 44 of the container 20 to line the bottom and side walls 36 and 32, and is sized to leave an extra portion or neck extending from mouth 44, which can be tied off and folded over into the container.

The end pads 24 are rectangular slabs that are thicker than the length of the protruding end pins on the tubes. The end pads 24 can include a layer of foam and are sized to fit snugly against the four side walls 32 of the container 20, thereby positioning bag 26 along the inside of the container walls. The lower pad is inserted in the bag 26 in the container 20 and wedges against the side walls 32. This preferably keeps the bottom of bag 26 generally fixed in the bottom of container 20.

Sleeves 22 are disposed in bag 26 and, as the packaging system 10 is oriented in FIGS. 1 and 2, sleeves 22 stand on the lower pad 24. The sleeves 22 are made from a spirally wound strip of paperboard finished to form a smooth tube. The diameter of sleeves 22 is chosen to closely encircle the given fluorescent lamp 12, which for the preferred embodiment is a 1.5 inch-diameter (3.8 cm) lamp. The sleeves 22 are arranged in bag 26 in a regular order or array, and preferably extend the full length of the tubes between the end pads, with their upper ends coplanar with one another in a plane spaced slightly below the plane of the mouth 44 so as to leave space for the upper end pad.

Figure 3:
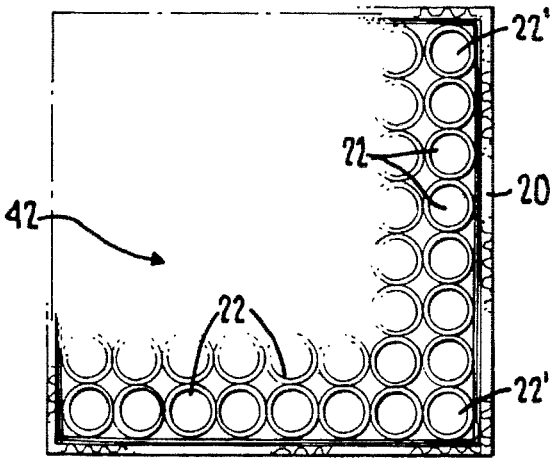
FIG. 3 is a section view taken along line III—III in FIG. 2.
Figure 4:
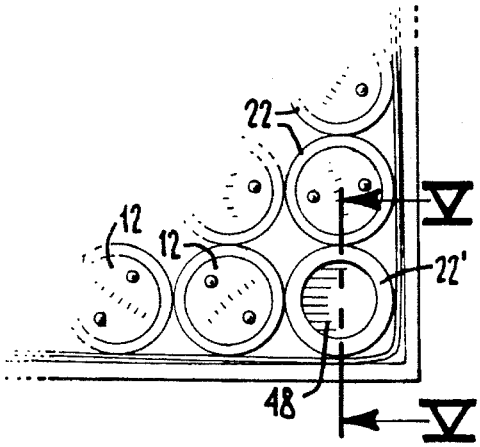
FIG. 4 is an enlarged detail taken from FIG. 3.
Figure 5:
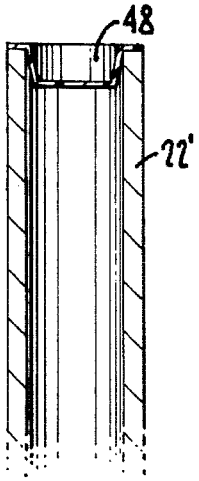
FIG. 5 is a section view taken along line V—V in FIG. 4, partly broken away.

FIG. 3 shows that the container 20 is preferably sized to hold sixty-four sleeves 22 in an eight-by-eight array. FIG. 4 shows that in each corner there is a corner-most sleeve 22' that preferably is plugged with a plug 48 (see also FIG. 5) to block insertion of a fluorescent lamp and maintain the corner space. The corner sleeves 22' are the ones most at risk of being deformed if the container 20 is dropped or otherwise abused, and it is advantageous to hold open the corner positions to avoid the relatively higher occurrence of lamp breakage that occurs there. Also the empty corner sleeves 22' act as shock absorbers and thus help safeguard lamps in other sleeves.

Given that the corner sleeves 22' are left empty, the carrying capacity for the packaging system 10 in the embodiment shown is sixty lamps with sixty-four sleeves. Other numbers and specific arrangements of sleeves 22 are possible. In nearly the same size container 20, for example, it is possible to load sixty eight sleeves, arranged in five rows of eight sleeves with four alternate rows of seven sleeves (not shown). The eight-by-eight arrangement is preferred to carry sixty standard four-foot (1.22 m), 1.5 inch-diameter (3.8 cm) fluorescent lamps with the corners unused.

A fully packed packaging system 10 loaded with sixty lamps weighs just under seventy pounds (32 kg), and meets a common weight limit imposed by major commercial carriers on packaging of this type. A standard fluorescent lamp of this type weighs approximately 0.6 pounds (0.25 kg), and the cumulative weight of the packaging 10 and sixty lamps is nominally seventy pounds. A bigger container carrying more lamps is possible and desirable in some instances, but will not qualify at some commercial carriers for their most favorable rates if more than seventy pounds.

Figure 6:
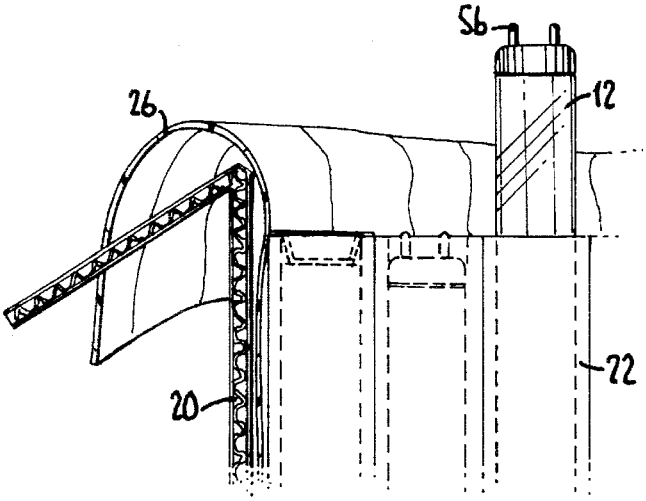
FIG. 6 is a section view taken in a vertical plane through the container in FIG. 2, partly broken away.

FIG. 6 shows spent lamps stowed in some of the sleeves and another lamp being inserted in an available other sleeve. The packaging system 10 conveniently can be stood upright and kept in an out-of-the way place by a user of fluorescent lamps, with the upper flaps 34 open. The container is loaded one lamp at a time as burnt out lamps are replaced. When full capacity is reached, the user of fluorescent lamps places the top end pad, closes the bag and closes the open end over the end pad, thereby urging it down onto the tube pins and the upper ends of the sleeves. The container is sealed and is ready to ship.

Figure 7:
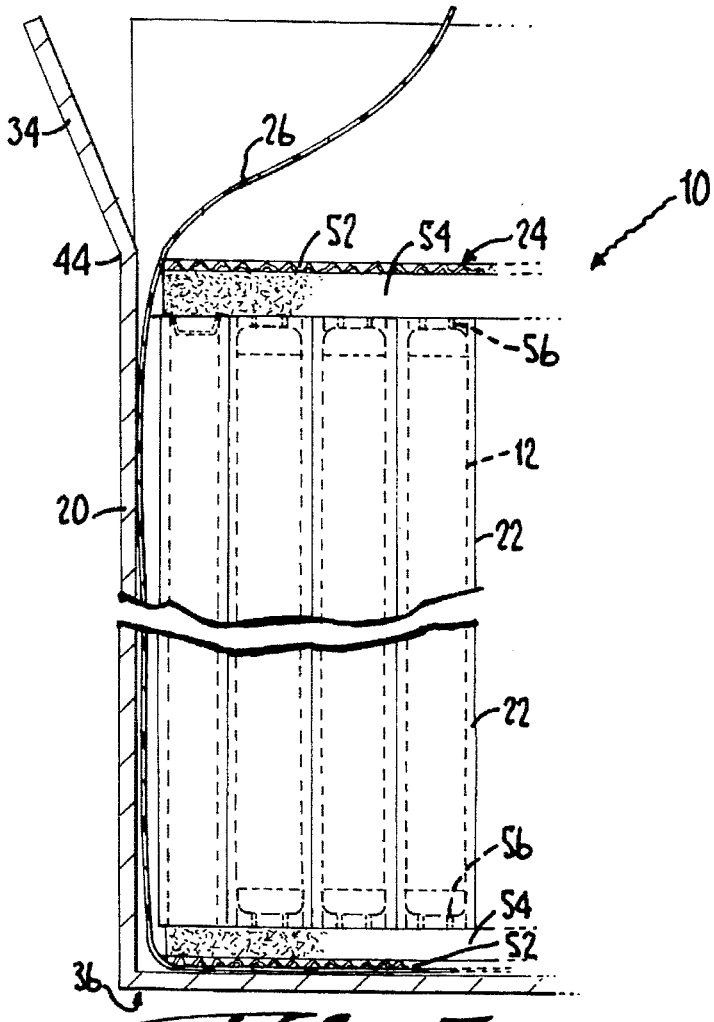
FIG. 7 is a section view taken in a vertical plane through the container in FIG. 2, partly broken away; and, FIG. 8 is a detail of FIG. 7 showing a cable wrap applied to the polyethylene bag.

FIG. 7 shows the packaging system 10 partly closed. Lamps 12 have been inserted in all but the corner sleeves 22 and the upper pad 24 is placed over the top ends of the tubes and sleeves. The upper and lower pads 24 can be identical and preferably comprise a composite construction. The pads 24 have a paperboard base layer 52 providing rigidity, bonded to a foam resilient layer 54 for mating with the ends of the sleeves 22. The foam 54 deforms to seal against the ends of the sleeves 22, which achieves several results.

The foam 54 establishes itself fully occupying each open end of a sleeve 22 for sufficiently forming a seal with the ends of the sleeves 22. This will capture pieces of any broken lamp, including shards of glass, the phosphors and so on. Containing the shards of glass importantly insulates the bag 26 from injury. Also, the lamps 12 have opposite sets of prong terminals 56, and these extend such that they will stab at least partly into the foam 54 at both the upper and lower ends of the lamps 12. These prong terminals 56 especially stab into the foam 54 of both of the opposite pads 24 after the upper pad 24 is pressed or urged down, as has already occurred in FIG. 7 and in any event occurs when the container is finally closed.

Foam 54 also acts as a shock-absorber against shocks oriented longitudinally relative to the tubes. It also protects bag 26 from injury from prong terminals 56. And the combined two pads 24 of foam 54 cooperate to clamp the lamps 12 between them, nearly fixed relative the container 20, except that very small displacements can occur as foam 54 absorbs shocks.

Figure 8:
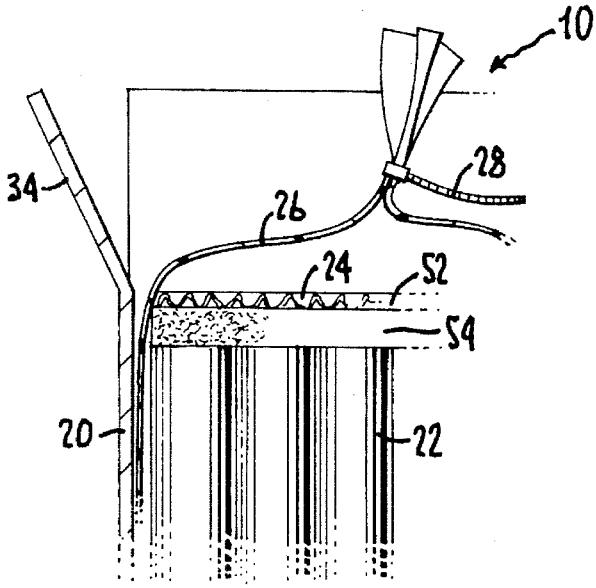

FIG. 8 shows the bag 26 having end extensions that can be gathered up and secured by a cable strap 28. The bag 26 prevents the escape from the container of mercury from any lamp that breaks. Bag 26 improves the extent to which the recycler can recover mercury that issues from broken lamps. After tying the bag 26 the container 20 can be closed simply by folding the flaps 34 shut and taping, stapling or otherwise appropriately fixing them in position.

At the recycler's facility, the container 20 is carefully opened to protect the upper flaps 34 for reuse. The cable strap 28 is cut carefully so that bag 26 can be reused. If none of the lamps has broken, they can be withdrawn from the sleeves for processing, and otherwise, as additional processing may be required. Bag 26 is inspected and if its integrity is not intact the bag is replaced. After these steps the packaging system 10 is ready for return to the generator of spent fluorescent lamps for refilling. Subject to wear and tear on the packaging system 10, many reuses are possible.

Although sleeves that are shorter than the lamps may be possible to space the tubes laterally, it is an inventive aspect of the packaging system 10 that sleeves 22 have a length corresponding to the length of the lamps to be packed (e.g., nominally four feet, or 1.22 m, long) plus an allowance so that the foam 54 interacts with the sleeves 22 and lamps 12 so that the tubes and their materials are supported and isolated as described and depicted. The container 20 has a height (in the direction up from its bottom 36) corresponding to the lamps 12, plus the two pads 24 when properly compressed to clamp the lamps as desired (plus the bag 26). The desired degree clamping occurs when the lamps 12 are clamped largely immovable relative to the container 20, but for the small-order displacements that occur when the foam absorbs shocks.

The packaging 10 preferably is constructed in accordance with appropriate Department of Transportation performance-oriented standards for packaging, e.g., 49 C.F.R. §§ 178.500 et seq. Such performance-oriented standards certify packaging based on its ability to survive certain defined tests. The assorted tests listed in 49 C.F.R. §§178.600 et seq. include drop tests, stacking tests, leakproof tests, hydrostatic pressure tests and so on. Each test gives three levels of abuse from which to chose, according to how much punishment the packaging is meant to survive. For example, the drop test mentions drop heights of 1.8 m (5.9 ft), 1.2 m (3.9 ft), and 0.8 m (2.6 ft), from which the packaging must be dropped with its contents surviving intact. It is preferred that the packaging 10 for used fluorescent lamps in accordance with the invention meet at least the lowest of the three levels for each test. The external portions of packaging 10 of the invention can be made relatively heavier or lighter and/or the end pad shock absorbers can be made thicker or thinner, in order to meet the standards at the desired level.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. Packaging for elongated glass lamps, comprising:

a container having end and side walls arranged to define a receptacle, one of the end walls defining a mouth for access to the receptacle, with a closure proximate edges of the side walls by which the mouth is open and shut, and another of the end walls being closed;

a liner having an opening and being placed in the container to line the end and side walls and with the opening of the liner being substantially coextensive with the mouth;

a plurality of elongated sleeves, each having opposite ends and being dimensioned for removable insertion of one of the lamps, the sleeves arranged laterally adjacent to one another in an array in the liner in the container;

end pads arranged in the liner in the container, one of the end pads being removably placeable at the mouth, the end pads being arranged to receive respective ends of the lamps, and to absorb shocks imparted to the container relative to the lamps when in the sleeves;

wherein the sleeves are sized to closely encircle the lamps, the liner is sized to extend around and enclose the combined sleeves and end pads, and the container when the closure is shut is sized and arranged to grip the lamps such that the lamps are carried in the sleeves in relatively immovable positions.

2. The packaging of claim 1, wherein the end pads comprise resilient inwardly facing layers operable to accommodate electrical pins of the lamps, the sleeves extending between and engaging with the end pads, whereby the lamps are enclosed by the end pads and a respective one of the sleeves.

3. The packaging of claim 2, wherein the inwardly facing layers are pierced by the electrical pins, the end pads having a thickness sufficient to receive the electrical pins such that the end pads protect the liner from damage by the electrical pins.

4. The packaging of claim 2, wherein the end pads comprise planar slabs of foam material.

5. The packaging of claim 1, wherein the end pad adjacent the closed wall of the container comprises a planar slab of foam material having a shape complementary to the container at the closed wall, such that said end pad adjacent the closed wall retains the liner in place along the side walls.

6. The packaging of claim 1, wherein the container comprises a rectangular box of corrugated paperboard, with foldably attached flaps defining at least one of the end walls.

7. The packaging of claim 1, wherein each sleeve comprises an elongated paperboard tube with an internal cross section complementary to an outside diameter of the lamps.

8. The packaging of claim 1, wherein the sleeves are arranged relative each other in an array and a given number of tubes are chosen to occupy substantially an entire space in the receptacle between the side walls of the container.

9. The packaging of claim 1, wherein the container comprises planar side walls attached to each other at longitudinal corners, and further comprising plugs closing sleeves that occupy positions adjacent each one of the corners, whereby the sleeves adjacent the corners are permitted to deform from impacts for protection of others of the sleeves containing lamps.

10. The packaging of claim 9, wherein the container is arranged to hold between 68 and 64 sleeves for shipping 64 and 60 lamps, respectively.

11. The packaging of claim 1, wherein the container and sleeves are dimensioned to accommodate fluorescent tube lamps of approximately four feet in length.

12. The packaging of claim 1, wherein the liner comprises a flexible polymeric bag for confining mercury vapor.

13. The packaging of claim 12, further comprising tie means for closing the bag at the mouth.

14. The packaging of claim 4, wherein the end pads comprise affixed layers of compressible foam and paperboard base, the foam being deformable to seal over ends of the sleeves.

15. The packaging of claim 4, wherein the end pads comprise a layer of compressible foam and wherein the end pads are pierceable by the electrical pins of the lamps.

* * * * *